US007819064B2

(12) United States Patent
Saenger et al.

(10) Patent No.: US 7,819,064 B2
(45) Date of Patent: Oct. 26, 2010

(54) SHAPED CHARGE AND A PERFORATING GUN

(75) Inventors: Richard Saenger, Chatillon (FR); Willehard Wortelboer, Bailly (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/875,097

(22) Filed: Oct. 19, 2007

(65) Prior Publication Data

US 2008/0282924 A1 Nov. 20, 2008

(30) Foreign Application Priority Data

Oct. 31, 2006 (EP) ..... 06291699

(51) Int. Cl.
*F42B 1/02* (2006.01)

(52) U.S. Cl. ..... 102/310; 102/476; 102/306

(58) Field of Classification Search ..... 102/476, 102/306–310; 166/297, 299, 55; 149/74; 175/4.6

See application file for complete search history.

(56) References Cited

U.S. PATENT DOCUMENTS 3,025,794 A * 3/1962 Lebourg et al. ..... 102/306
3,054,938 A 9/1962 Meddick
3,188,955 A 6/1965 Brown
3,190,219 A 6/1965 Venghiattis
3,224,368 A * 12/1965 House ..... 102/306
3,437,036 A * 4/1969 Roland et al. ..... 102/476
3,675,575 A * 7/1972 Bailey et al. ..... 102/306
3,762,326 A 10/1973 Edgell et al.
3,867,272 A * 2/1975 Rust et al. ..... 204/194
4,598,643 A * 7/1986 Skrocki ..... 102/307
4,649,828 A * 3/1987 Henderson et al. ..... 102/476
4,702,171 A * 10/1987 Tal et al. ..... 102/476
H464 H * 5/1988 Lee et al. ..... 102/364
4,756,371 A * 7/1988 Brieger ..... 166/312
5,098,487 A * 3/1992 Brauer et al. ..... 102/476
5,175,391 A * 12/1992 Walters et al. ..... 102/307
5,221,808 A * 6/1993 Werner et al. ..... 102/307
5,349,908 A * 9/1994 Walz et al. ..... 102/307
5,351,622 A * 10/1994 Ekholm ..... 102/476
5,413,048 A * 5/1995 Werner et al. ..... 102/307
5,522,319 A * 6/1996 Haselman, Jr. ..... 102/306
5,744,747 A * 4/1998 Renaud-Bezot et al. ..... 102/476
5,936,184 A * 8/1999 Majerus et al. ..... 102/306
6,152,040 A * 11/2000 Riley et al. ..... 102/306
6,354,219 B1 * 3/2002 Pratt et al. ..... 102/307
6,393,991 B1 * 5/2002 Funston et al. ..... 102/476
6,983,698 B1 * 1/2006 Walters et al. ..... 102/307
7,712,416 B2 * 5/2010 Pratt et al. ..... 102/476
2005/0115448 A1 * 6/2005 Pratt et al. ..... 102/476
2007/0053785 A1 * 3/2007 Hetz et al. ..... 102/306
2009/0235836 A1 * 9/2009 Pratt et al. ..... 102/306

* cited by examiner

*Primary Examiner*—Michael Carone
*Assistant Examiner*—Jonathan C Weber
(74) *Attorney, Agent, or Firm*—Myron K. Stout

(57) ABSTRACT

A shaped charge comprises a shell, an explosive charge disposed inside the shell, and a first liner for retaining the explosive charge within the shell. The shaped charge further comprises an acid material disposed inside the shell on the first liner and retained by a second liner into the shell.

14 Claims, 3 Drawing Sheets

FIG. 1 - PRIOR ART

SHAPED CHARGE AND A PERFORATING GUN

FIELD OF THE INVENTION

An aspect of the invention relates to a shaped charge. Another aspect of the invention relates to a perforating gun comprising at least one of such shaped charge. A further aspect of the invention relates to a method for perforating in a well. The invention finds a particular application in the oil-field industry, more precisely during perforating operations.

BACKGROUND OF THE INVENTION

FIG. 1 shows, in a schematic manner, a typical onshore hydrocarbon well location and surface equipment SE above a hydrocarbon geological formation GF after a well-bore WB drilling operation has been carried out, after a casing string has been run, after cementing operations have been carried out and after various logging operations for detecting interesting zones have been carried out.

At this stage, i.e. before exploitation can begin, the cemented casing CC must be perforated so that a selected zone SZ of the formation is put into communication with the well-bore WB. Accordingly, a perforating gun 1 suspended on line LN is lowered at a determined depth. Typically, such a perforating gun 1 loaded with many/various charges, e.g. shaped charge SC, is disclosed in the document US 2002/0189482. The detonation of the charges creates perforation, namely openings into the cemented casing continuing by a tunnel into the formation, thus allowing the fluid contained in the selected zone to enter into the well casing or the fluid pumped from the surface to be injected into the selected zone. However, during the perforation operation, the material of the shaped charge may clog the perforation. For example, the molten plastic liner may recover the interior of the perforation. As a consequence, the flow of fluid through the perforation may be hampered. Though various liners have been proposed in the past in order to avoid, or at least limit the effect of clogging, they are still not entirely satisfactory in the oil-field applications.

SUMMARY OF THE INVENTION

It is an object of the invention to propose a shaped charge that overcomes at least one of the drawbacks of the prior art.

The invention proposes a shaped charge comprising an acid material, the shaped charge being such that the acid injected into the perforation cleans it after the detonation of the shaped charge.

According to a first aspect, the invention relates to a shaped charge comprising a shell, an explosive charge disposed inside the shell, a first liner to retain the explosive charge within the shell. The shaped charge further comprises an acid material disposed inside the shell on the first liner and retained by a second liner onto the shell.

The acid material may be an acid powder layer retained between the first liner and a protective liner, or an acid compound encapsulated into an encapsulating liner disposed on the first liner. The acid material may also be encapsulated in micro-spheres made of plastic material.

The acid material may be crystaline $H_2SO_4$, perchloric acid $HClO_4$ (1-2)$H_2O$ mono and dehydrated, or trichloroacetic acid $CCl_3COOH$.

The material comprising the first liner may be titanium, titanium alloy, titanium powder mixed with another metal powder, titanium alloy powder mixed with another metal powder, boron, boron alloy, lithium, lithium alloy, aluminum, aluminum alloy, silicon, silicon alloy, magnesium, or magnesium alloy. The first liner may further comprise a reducing agent or an oxidizing agent.

According to a further aspect, the invention relates to a perforating gun adapted to be positioned at a determined depth in a well. The perforating gun comprises a control module and at least one shaped charge according to the invention coupled to the control module.

According to a further aspect, the invention relates to a method for perforating in a well, comprising the following steps:

- positioning a perforating gun at a determined depth in the well, the perforating gun comprising at least one shaped charge comprising a shell, an explosive charge disposed inside the shell, a first liner for retaining the explosive charge into the shell, an acid material disposed inside the shell on the first liner and retained by a second liner into the shell;
- detonating the shaped charge to form a perforation in a selected zone of a formation; and
- allowing the acid material to react with the fluid present in the perforation in order to clean the perforation.

The shaped charge of the invention enables acidizing a perforated formation, in-situ, without an additional acidification operation. This enables the cleaning of the perforations in a very efficient way, a few seconds after the perforation. As a consequence, the operating rig time can be saved for other operations.

These and other aspects of the invention will be apparent from and elucidated with reference to the embodiments described hereinafter.

BRIEF DESCRIPTION OF THE DRAWINGS

The present invention is illustrated by way of example and not limited to the accompanying figures, in which like references indicate similar elements.

DETAILED DESCRIPTION OF THE INVENTION

Figure 1:
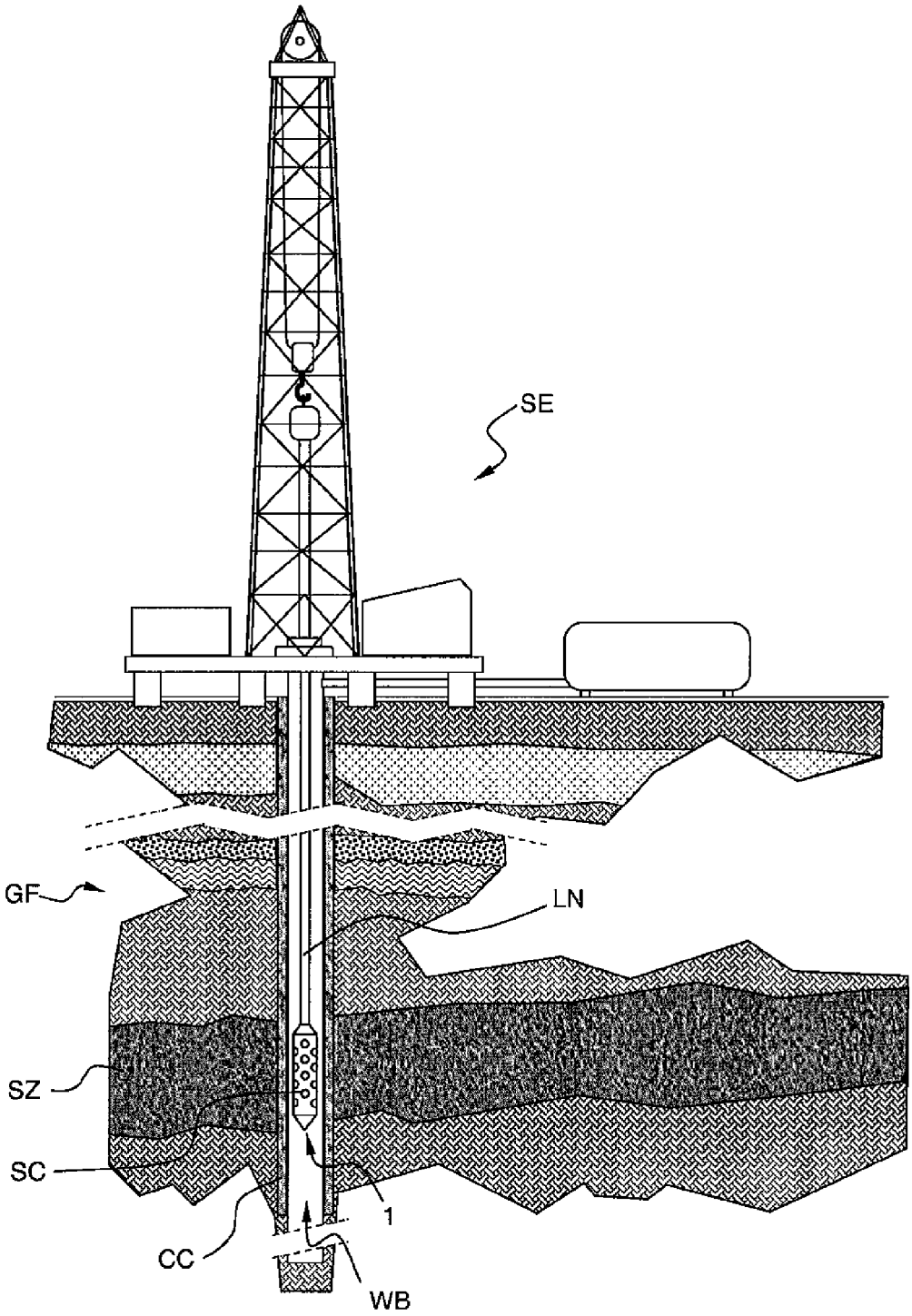
FIG. 1 schematically represents a typical on-shore hydrocarbon well location.
Figure 2:
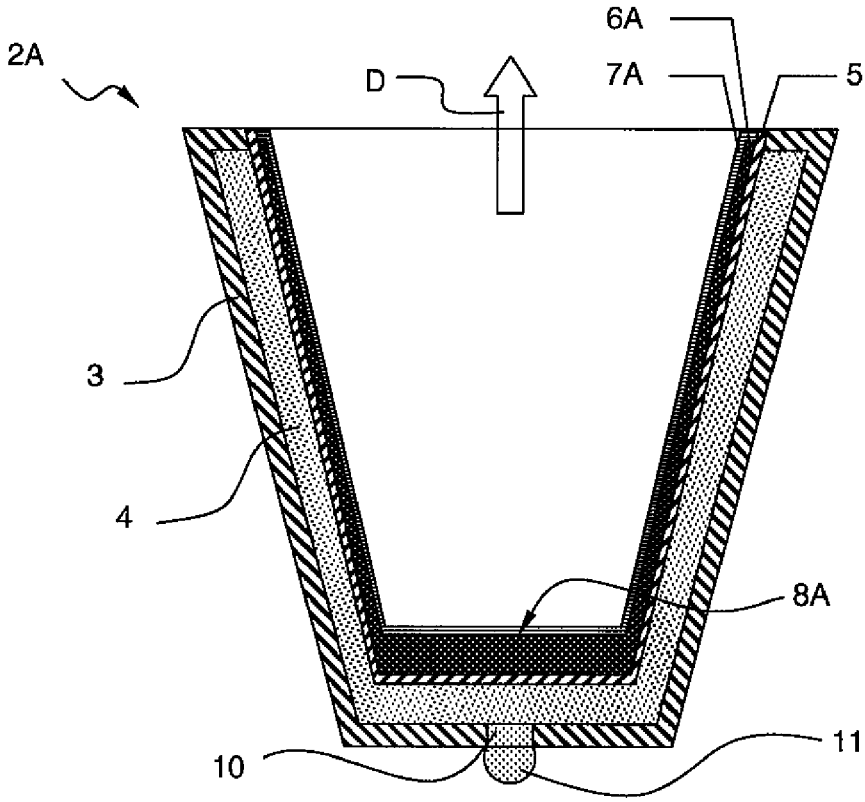
FIG. 2 is a cross-section view into a shaped charge according to a first embodiment of the invention.

FIG. 2 is a cross-section view into a shaped charge according to a first embodiment of the invention.

The shaped charge of the first embodiment 2A comprises a shell 3, an explosive charge 4, a liner 5, an acid powder layer 6A, a protective liner 7A and a detonating link element 10.

The shell 3 is similar to a cup having a U-shape, frusto-conical shape, or cone shape. The shell 3 has a bottom, a top, and a side wall extending between the top and the bottom. The top may define a ring extending into an interior of the shell 3. The shell supports the explosive material and is adapted to be housed in the perforating gun, or in a loading tube (not represented) of the perforating gun. Once the shaped charge is detonated, the shell acts as a confining element providing sufficient confinement to help in forming a perforating jet that is directed in the longitudinal direction (see arrow D in FIGS. 2 and 3). For this reason, the shell is made in a robust material, e.g. steel. The explosive charge 4 is made of an explosive material packed against the inner wall of the shell.

The detonating link element 10 goes through an opening in the bottom of the shell 3 and couples the explosive charge 4 to a detonating cord 11.

For example, the explosive material may be RDX (hexahydro-1,3,5-trinitro-1,3,5-triazine), HMX (1,3,5,7-tetranitro-1,3,5,7-tetraazacyclooctane), TATB (triaminotrinitrobenzene), HNS (hexanitrostilbene), PYX (2,6-bis picrylamino-3,5-dinitropyridine).

Figure 3:
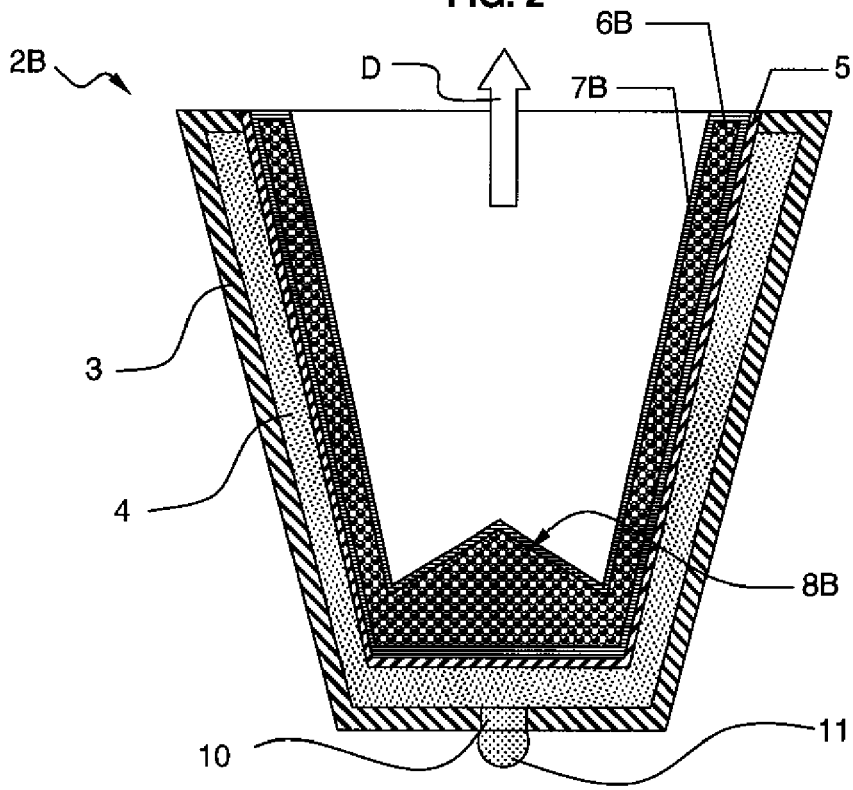
FIG. 3 is a cross-section view into a shaped charge according to a second embodiment of the invention.

The liner 5 lines the explosive charge 4 supported by the shell 3 and acts to maintain the shape of the explosive during propagation of the detonation. As shown in FIGS. 2 and 3 the liner 5 is a frusto-conical liner which engages and/or couples to an inner perimeter of the ring defined by the top of the shell 3. The liner 5 may couple to the shell 3 using any suitable method known in the art. Advantageously, the liner 5 is a heavy metal liner. The heavy metal liner is, for example, made of Tungsten W, Copper Cu, Lead Pb or Cobalt Co. The heavy metal liner may have a thickness ranging between 1 mm to 2 mm, thus enhancing the penetration depth of the shaped charge. As an alternative, the liner 5 may also comprise one or more of the following metals: titanium, titanium alloy, titanium powder mixed with another metal powder, titanium alloy powder mixed with another metal powder, boron, boron alloy, lithium, lithium alloy, aluminum, aluminum alloy, silicon, silicon alloy, magnesium, or magnesium alloy. Further, the liner 5 may also comprise a reducing agent (iron, manganese, molybdenum, sulfur, selenium, and zirconium) or an oxidizing agent (PbO, Pb3O4, KClO4, KClO3, Bi2O3, and K2Cr2O7).

Advantageously, the acid powder layer 6A is a layer of compressed acid powder, for example dehydrated acid powder (under a crystalline form). As an example, a uniform coating of a few tens of millimeters of dehydrated acid powder is deposited on the liner 5. The acid powder layer may be uniformly sputtered on the liner 5, thus having substantially the same thickness all over the liner. As an alternative, the acid powder layer may be thicker at the bottom 8A than against the lateral wall of the liner. The acid powder may be crystalline $H_2SO_4$, perchloric acid $HClO_4$ (1-2)$H_2O$ mono or dehydrated, or trichloroacetic acid $CCl_3COOH$, etc. . . The acid concentrations may range from 5 to 15% (for hydrochloric HCl equivalent) dilution in water.

The protective liner 7A prevents the re-hydration of the acid powder. The protective liner 7A may be made of any material preventing penetration of humidity into the acid powder, e.g. a protective layer of plastic or wax.

As an alternative (not shown) the acid powder may be partly mixed with the liner 5. The acid powder may also be protected by a protective liner under the form of a water tight rubber sprayed or injected all over the exterior of the shaped charge (alternative not shown).

FIG. 3 is a cross-section view into a shaped charge according to a second embodiment of the invention.

The shaped charge of the second embodiment 2B comprises a shell 3, an explosive charge 4, a liner 5, an acid compound 6B, an encapsulating liner 7B and a detonating link element 10.

The elements of the second embodiment that are common with the first embodiment, namely the shell 3, the explosive powder 4, the liner 5 and the detonating link element 10 will not be further described.

The acid compound 6B may be made of spheres or micro-spheres filled with an acid. The acid may be in the physical state of a fluid, a gel or a solid.

The encapsulating liner 7B is a protective shell which encapsulates the spheres or micro-spheres and prevents water contact or deterioration of the spheres or micro-spheres before the beginning of the perforation operation. As shown in FIG. 3, the encapsulating liner 7B has a frusto-conical outer membrane, an inner membrane and a top for coupling, or connecting the frusto-conical outer membrane to the inner membrane. The frusto-conical outer membrane may have an outer membrane bottom substantially parallel to the bottom of the shell 3 and an outer membrane side wall substantailly parallel to the shell side walls. The inner membrane may have an inner membrane side wall located within the outer membrane side wall and substantially parallel thereto. As an example, the protective shell may be polyethylene. The encapsulating liner 7B may have a uniform thickness all over the liner 5. As an alternative, the encapsulating liner 7B may be thicker at the bottom 8B than against the lateral wall of the liner 5. For example, as shown in FIG. 3, a bottom of the inner membrane has a raised portion defining a peak, or an apex, pointed in the jetting direction toward the top of the shell 3 for retaining more acid within the encapsulating liner 7B.

As an alternative (not shown) an acid filled capsule or several acid filled capsules may be attached on the shaped charge. For example, the capsule(s) may be glued in the hollow portion of the shaped charge, against the wall and/or on the bottom of the shaped charge.

The operation of the shaped charge will now be described in relation with FIGS. 4 and 5.

Figure 4:
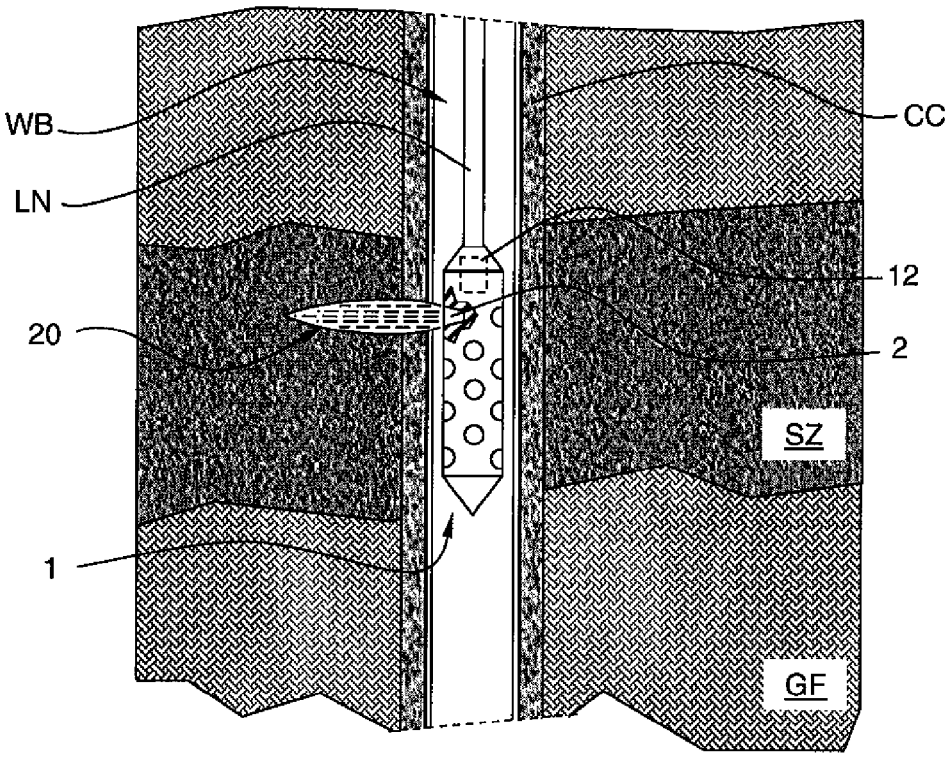
FIG. 4 schematically represents a detail view of a perforating gun comprising a shaped charge according to one embodiment of the invention when perforating a cemented casing and a formation.

FIG. 4 schematically represents a detail and partial cross-section view of a perforating gun 1 comprising a control module 12 and at least one shaped charge 2 according to any one of the embodiment of the invention during a perforation operation. The perforation operation aims at perforating a cemented casing CC and selected zone SZ of a formation. The perforating gun 1 is positioned at the desired depth. A detonation command is send from the surface and received by the control module 12. The perforating gun 1 detonates the shaped charges. For the sake of simplicity and clarity of the drawings, only one shaped charge is shown detonating. However, it will be apparent for a person skilled in the art that a better efficiency is achieved through quasi-simultaneous detonation of all the shaped charges. The shaped charges may be positioned according to various patterns. Once the command is received, a detonation wave is generated by the control module 12 and propagates within the detonation cord 11 (see FIGS. 2 and 3). The detonation wave detonates the detonating link element 10 which further detonates the explosive charge 4. The liner 5, the acid powder 6A or the acid compound 6B, the protective liner 7A or the encapsulating liner 7B collapses and forms a jet 20. The jet 20 which is directed along the longitudinal axis of the shaped charge perforates the cemented casing CC and the selected zone SZ of the formation.

Figure 5:
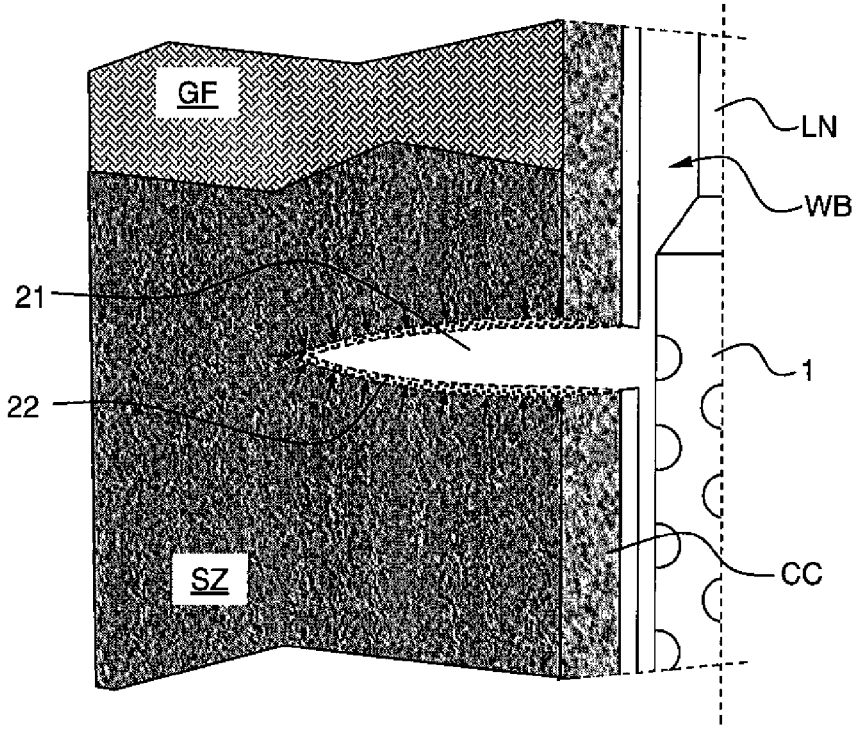
FIG. 5 schematically illustrates the cleaning of the perforation by the acid of the shaped charge according to one embodiment of the invention.

FIG. 5 schematically illustrates the cleaning of the perforation by the acid of the shaped charge according to any one of the embodiment of the invention.

The detonation and jet creates a shock wave that generally damages a layer of the selected zone adjacent to the perforation 21. Further, the wall of the perforation may be clogged with residual material (e.g. the liners of the shaped charge). The damaged layer and the residual material decrease the permeability of the selected zone adjacent to the perforation wall. Once the shaped charge is fired, firstly, most of the acid material will be dragged into the perforation 21, and, secondly, as soon as the acid material will be in contact and react with the fluid presents in the perforation (a water base composition, mud, brine, etc. . .) the acid material will be in solution "in-situ". Thus, the perforation will be acidized during the perforation or immediately after (a fraction of second after) all along the perforation length. Typically, an acidized layer 22 will be formed at the boundary between the perforation 21 and the formation. The in-situ acid solution formed into the perforation and the acidized layer enables an efficient cleaning of the perforation, namely decomposition of the residual material and of the damaged layer. As a consequence, any residual material from the shaped charge that may clog the perforation is eliminated, or at least greatly reduced. Thus, the permeability is increased and the penetration of the formation fluid into the perforation and further into the well bore WB is facilitated. Consequently, the hydrocarbon productivity of the selected zone is increased.

As the acid concentrations may typically range from 5 to 15% (for hydrochloric HCl equivalent) dilution in water, the shaped charge of the invention and its associated cleaning method can be considered as "environmentally" friendly because only a controlled and necessary amount of acid is released while providing an efficient cleaning. In fact, the acid is delivered "in-situ" without harming the selected zone and the immediate vicinity of the well-bore.

Further, the invention enables simultaneous perforation and cleaning operation to take place, thus saving rig time because a separate acidifying operation is not necessary. It is also safer than an acidifying operation because the perforating gun comprising the shaped charge of the invention is safer to manipulate by an operator than implementing an acidifying operation from the surface which involves the injection of liquid acid.

When the liner further comprises particular materials like metals, oxidizing or reducing agent as described hereinbefore, the cleaning effect may be further enhanced and additional formation fracturing effect may occur. The fracturing effect is mainly due to thermal stress created by the exothermic reactions between these particular materials and a formation substantially made of carbonate.

The shaped charge of the invention may be manufactured according to existing techniques known by the person skilled in the art that will not be further described.

The drawings and their description hereinbefore illustrate rather than limit the invention.

In particular, the invention has been described in relation with the perforation of a cased well. However, a person skilled in the art would recognize that the invention is also applicable to a non-cased well. Further, the invention is not limited to the particular example of the onshore hydrocarbon well application and may be used in an offshore application. Furthermore, the application to oilfield industry is not limitative, as the invention may be used in others geophysical applications (water extraction, $CO_2$ geological storage, etc. . . ). Finally, the description of a perforating gun suspended to a line to deploy and fire the shaped charges is only an example; any other deploying and firing techniques may be used.

Any reference sign in a claim should not be construed as limiting the claim. The word "comprising" does not exclude the presence of other elements than those listed in a claim. The word "a" or "an" preceding an element does not exclude the presence of a plurality of such element.

The invention claimed is:

1. A shaped charge comprising:

a shell having a frusto-conical shape wherein the shell comprises:

a bottom;

a top defining a ring extending into an interior of the shell; and a side wall extending between the bottom and the top and wherein a first end of the side wall engages an outer perimeter of the bottom and a second end of the side wall engages an outer perimeter of the ring defined by the top;

an explosive charge disposed inside the shell; and a first liner having a frusto-conical shape for retaining the explosive charge between the first liner and the shell and wherein the first liner engages an inner perimeter of the ring defined by the top of the shell;

wherein the first liner comprises at least one material selected from the group consisting of a reducing agent and an oxidizing agent;

wherein the shaped charge further comprises an acid material disposed inside the shell on the first liner and retained by a second liner into the shell, the second liner comprising an encapuslating membrane for housing the acid matertial, the encapsulating membrane comprising:

a frusto-conical outer membrane; and an inner membrane having an inner membrane bottom comprising a conically shaped bottom having a peak that is pointed toward a jetting direction.

2. A shaped charge according to claim 1, wherein the acid material is an acid powder layer.

3. A shaped charge according to claim 1, wherein the acid material is an acid compound encapsulated with the second liner.

4. A shaped charge according to claim 1, wherein the acid material is encapsulated in micro-spheres.

5. A shaped charge according to claim 1, wherein the acid material is selected from the group consisting of crystaline $H_2SO_4$, perchloric acid $HClO_4$ (1-2)$H_2O$ mono and dehydrated, and trichloroacetic acid $CCl_3COOH$.

6. A shaped charge according to claim 1, wherein the first liner further comprises at least one material selected from the group consisting of titanium, titanium alloy, titanium powder mixed with another metal powder, titanium alloy powder mixed with another metal powder, boron, boron alloy, lithium, lithium alloy, aluminum, aluminum alloy, silicon, silicon alloy, magnesium, and magnesium alloy.

7. The shaped charge according to claim 1, wherein the first liner comprises:

a first liner bottom substantially parallel to the bottom of the shell; and a first liner side wall extending from the ring of the shell to the first liner bottom and wherein the first liner side wall is substantially parallel to the side wall of the shell.

8. The shaped charge according to claim 7, wherein the encapsulating membrane further comprises:

the frusto-conical outer membrane comprising:

an outer membrane bottom substantially parallel to the bottom of the shell and the first liner bottom;

an outer membrane side wall substantially parallel to the shell and the first liner side walls;

the inner membrane further comprises an inner membrane side wall located within the outer membrane side wall and substantially parallel to the outer membrane side wall; and an encapsulating membrane top for coupling the top of the outer membrane side wall to the inner membrane side wall.

9. A perforating gun adapted to be positioned at a determined depth in a well, comprising:

a control module; and a shaped charge operatively coupled to the control module, the shaped charge comprising:

a shell having a frusto-conical shape wherein the shell comprises:

a bottom;

a top defining a ring extending into an interior of the shell; and a side wall extending between the bottom and the top and wherein a first end of the side wall engages an outer perimeter of the bottom and a second end of the side wall engages an outer perimeter of the ring defined by the top;

an explosive charge disposed inside the shell; and a first liner having a frusto-conical shape for retaining the explosive charge between the first liner and the shell and wherein the first liner engages an inner perimeter of the ring defined by the top of the shell, wherein the first liner comprises at least one material selected from the group consisting of a reducing agent and an oxidizing agent;

wherein the shaped charge further comprises an acid material disposed inside the shell on the first liner and retained by a second liner into the shell, the second liner comprising an encapuslating membrane for housing the acid matertial, the encapsulating membrane comprising:

a frusto-conical outer membrane; and an inner membrane having an inner membrane bottom comprising a conically shaped bottom having a peak that is pointed toward a jetting direction.

10. The perforating gun according to claim 9, wherein the first liner comprises:

a first liner bottom substantially parallel to the bottom of the shell; and a first liner side wall extending from the ring of the shell to the first liner bottom and wherein the first liner side wall is substantially parallel to the side wall of the shell.

11. The perforating gun according to claim 10, wherein the encapsulating membrane further comprises:

the frusto-conical outer membrane comprising:

an outer membrane bottom substantially parallel to the bottom of the shell and the first liner bottom;

an outer membrane side wall substantially parallel to the first liner side walls;

the inner membrane further comprises an inner membrane side wall located within the outer membrane side wall and substantially parallel to the outer membrane side wall; and an encapsulating membrane top for coupling the top of the outer membrane side wall to the inner membrane side wall.

12. A method for perforating in a well, comprising the steps of:

positioning a perforating gun at a determined depth in the well, the perforating gun comprising at least one shaped charge comprising a shell having a frusto-conical shape wherein the shell comprises:

a bottom;

a top defining a ring extending into an interior of the shell; and a side wall extending between the bottom and the top and wherein a first end of the side wall engages an outer perimeter of the bottom and a second end of the side wall engages an outer perimeter of the ring defined by the top, an explosive charge disposed inside the shell, a first liner having a frusto-conical shape for retaining the explosive charge between the first liner and the shell and wherein the first liner engages an inner perimeter of the ring defined by the top of the shell, an acid material disposed inside the shell on the first liner and retained by a second liner into the shell, wherein the first liner comprises at least one material selected from the group consisting of a reducing agent and an oxidizing agent, wherein the second liner comprising an encapsulating membrane for housing the acid material, the encapsulating membrane comprising:

a frusto-conical outer membrane;

an inner membrane having an inner membrane bottom comprising a conically shaped bottom having a peak that is pointed toward a jetting direction;

detonating the shaped charge to form a perforation in a selected zone of a formation; and allowing the acid material to react with any fluid present in the perforation in order to clean the perforation.

13. The method for perforating in a well according to claim 12, wherein the first liner comprises:

a first liner bottom substantially parallel to the bottom of the shell; and a first liner side wall extending from the ring of the shell to the first liner bottom and wherein the first liner side wall is substantially parallel to the side wall of the shell.

14. The method for perforating in the well according to claim 13, wherein the encapsulating membrane further comprises:

the frusto-conical outer membrane comprising:

an outer membrane bottom substantially parallel to the bottom of the shell and the first liner bottom;

an outer membrane side wall substantially parallel to the first liner side walls;

the inner membrane further comprises an inner membrane side wall located within the outer membrane side wall and substantially parallel to the outer membrane side wall; and an encapsulating membrane top for coupling the top of the outer membrane side wall to the inner membrane side wall.

* * * * *